US005502479A

United States Patent [19]

Ishinaga et al.

[11] Patent Number: 5,502,479

[45] Date of Patent: Mar. 26, 1996

[54] INK JET CARTRIDGE AND INK JET APPARATUS HAVING SAME

[75] Inventors: Hiroyuki Ishinaga, Tokyo; Masami Ikeda, Yokohama; Tsutomu Abe, Isehara; Seiichiro Karita, Yokohama; Teruo Arashima, Kawasaki, all of Japan

[73] Assignee: Canon Kabushiki Kaisha, Tokyo, Japan

[21] Appl. No.: 76,979

[22] Filed: Jun. 16, 1993

[30] Foreign Application Priority Data

Jun. 16, 1992 [JP] Japan ..... 4-181798

[51] Int. Cl.[6] ..... B41J 2/175

[52] U.S. Cl. ..... 347/93; 210/497.01; 347/87

[58] Field of Search ..... 347/93, 87, 86; 210/497.3, 497.01

[56] References Cited

U.S. PATENT DOCUMENTS

| | | | |
|---|---|---|---|
| 3,708,118 | 1/1973 | Keur | 347/93 X |
| 3,779,390 | 12/1973 | Oberthur | 210/497.01 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,771,295 | 9/1988 | Baker | 347/87 |
| 4,967,207 | 10/1990 | Ruder | 347/87 |
| 5,051,759 | 9/1991 | Karita et al. . | |
| 5,155,502 | 10/1992 | Kimura et al. . | |

FOREIGN PATENT DOCUMENTS

| | | | |
|---|---|---|---|
| 0261764 | 3/1988 | European Pat. Off. | B41J 27/18 |
| 0320165 | 6/1989 | European Pat. Off. | B41J 3/04 |
| 2136531 | 12/1972 | France | B41J 3/00 |
| 59-033154 | 2/1984 | Japan | B41J 3/04 |
| 59-123670 | 7/1984 | Japan . | |
| 59-138461 | 8/1984 | Japan . | |
| 60-234848 | 11/1985 | Japan | B41J 3/04 |
| 1133747 | 5/1989 | Japan | B41J 3/04 |
| 3293155 | 12/1991 | Japan | B41J 2/175 |

*Primary Examiner*—Joseph W. Hartary
*Attorney, Agent, or Firm*—Fitzpatrick, Cella, Harper & Scinto

[57] ABSTRACT

An ink jet cartridge includes a head portion, an ink container portion; an ink passage for supplying ink from the ink container portion to the head portion, ink absorbing material in the ink container, and a filter press-contacted to the ink container. The filter adjacent to an end of the ink passage and has an area larger than a cross-sectional area of the ink passage.

10 Claims, 4 Drawing Sheets

INK JET CARTRIDGE AND INK JET APPARATUS HAVING SAME

FIELD OF THE INVENTION AND RELATED ART

The present invention relates to an ink jet cartridge and an ink jet apparatus usable with the ink jet cartridge wherein a recording head and a ink container are integral.

In the ink jet type recording apparatus, the ink is ejected onto a recording material from a recording means (recording head) in accordance with an image signal. It is advantageous in that the size of the recording means can be reduced, that fine images can be recorded at a high speed, that plain paper is usable without special treatment therefor, that the running cost is low, that the noise is small because it is a non-impact type, and that it is easy to effect the color image recording with the use of a plurality of different color inks. Among them, a full-multiple recording means having a great number of ejection outlets arranged in the direction of the width of the sheet is advantageous because the recording speed can be further increased. Particularly, an ink jet type recording means (recording head) which ejects the ink using thermal energy can be easily manufactured with high density liquid passages (ejection outlets), since it can be manufactured by etching, evaporation, sputtering or another semiconductor manufacturing process to manufacture electrothermal transducers, electrodes, liquid passages and a top plate. The electrothermal transducers and electrodes are formed as films on a substrate. In addition, a high resolution image can be recorded at a high speed with a simple and compact structure. On the other hand, various materials for the recording material are desired to be used. Recently, in addition to the usual plain paper or thin resin sheet (OHP sheet or the like), a thin sheet of paper or processed sheet (the sheet having perforations for the filing, the sheets with cutting perforations, or non-rectangular sheet) are desired to be used with printers.

In one type of ink jet recording apparatus, an ink supply tube is connected to a recording head carried on a carriage of the recording apparatus to supply the ink thereto from an exchangeable type ink cartridge. In the other type of the apparatus, an integral recording head and ink container is detachably mounted on the carriage of the apparatus.

In the latter case, the ink jet cartridge is particularly suitable for personal use because of its small size, low cost and easy handling.

In the ink jet cartridge type, the recording head and the ink container communicate with each other by insertion of an ink supply pipe of the recording head into the ink container. There are two types from the standpoint of the ink container. In the first type, liquid ink is accommodated in an elastic bladder, and in the other type, the ink is contained in an ink absorbing material. In either of the types of the ink jet cartridge, the ink supply passage is provided with a filter to prevent introduction of foreign manner and bubbles into the recording head. In the case of the ink container having therein an ink absorbing material, the configuration of the ink supply passage and the configuration of the filter have been determined without consideration to the elastic property of the ink absorbing material or to the ink supply mechanism, and therefore, the ink therein becomes non-usable despite a great amount of ink remaining therein. For example, the filter is flat or concave. In these cases, the contact pressure between the filter and the ink absorbing material is not enough with the result of air space around filter surface or lower capillary force due to the density decrease of the ink absorbing material. If this occurs, the ink is not easily supplied to the supply portion. As a result, the resistance against the flow of the ink at the supply part becomes large with the result of disturbance to the ink ejection due to the insufficient ink supply, even to such an extent that the ink supply becomes impossible despite a large amount of ink remaining in the container. If this occurs, the ink is no longer ejected.

In the recording cartridge used in the conventional ink jet recording apparatus, the filter constitutes a flat or concave surface, and the ink passage is straight. This structure involves the following problems. First, the configuration of the filter becomes concave, or the concavity is enhanced by the pressure of the ink absorbing material. Second, the pressure of the ink absorbing material is maximum at corners of the ink passage with the result of reduction of the contact pressure at the filter surface and permanent deformation of the ink absorbing material. Third, since the ink supply passage is straight, the ink absorbing material adjacent the base portion of the ink supply passage is separated from the inside surface of the ink container by the insertion of the ink supply pipe, with the result that air is introduced through the clearance formed between the surface and the deformed ink absorbing material.

If this situation occurs, the ink supply becomes insufficient due to the increase of the resistance against ink flow at the ink supply portion with the result of disturbance to the ink ejection. Or, an air layer completely blocking the ink flow is formed at the filter, disabling the ink supply. If this occurs, the ink is no longer ejected despite a great amount of ink remaining in the container.

SUMMARY OF THE INVENTION

Accordingly, it is a principal object of the present invention to provide an ink jet cartridge and an ink jet recording apparatus using the same in which the ink can be supplied in the proper stabilized manner until no or only a small amount of ink remains in the container, thus stabilizing the ink ejection.

According to an aspect of the present invention, there is provided an ink jet cartridge comprising: a head portion; an ink container portion; an ink passage for supplying ink from the ink container portion to the head portion; ink absorbing material in the ink container; and a filter press-contacted to the ink container. The filter press-contacted to the ink absorbing material is located adjacent an end of the ink passage and has an area larger than a cross-sectional area of the ink passage.

According to another aspect of the present invention, there is provided an ink jet recording apparatus for ejecting ink from recording means onto a recording material, in which the recording means and an ink container constitute an integral unit, comprising a filter press-contacted to the ink absorbing material at an ink supply passage for supplying the ink from the absorbing material in the ink container to the recording means. The filter has a convex configuration toward the ink absorbing material.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
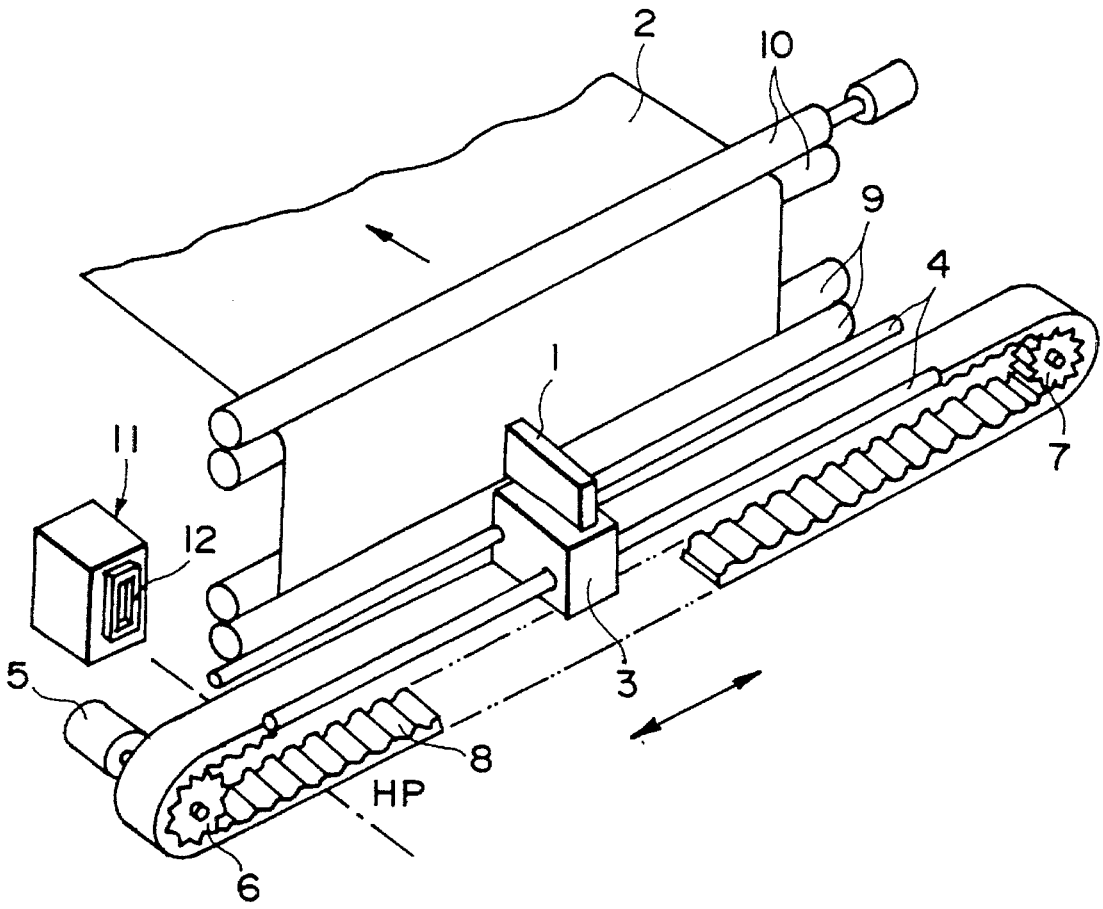
FIG. 1 is a schematic perspective view of an ink jet recording apparatus according to a first embodiment of the present invention.

FIG. 1 shows an ink jet recording apparatus according to a first embodiment of the present invention. In this figure, the ink jet recording cartridge is constructed such that the ink is ejected onto the recording material such as a sheet of paper or plastic thin material from a recording cartridge 1, thus effecting the recording operation. The recording cartridge is detachably mountable on a carriage 3. The carriage 3 is supported and guided on a guide rail 4 for reciprocal movement in the directions indicated by arrows, the guide rail 4 being extended in parallel with the recording material 2. The carriage 3 is driven by a motor 5 through a timing belt 8 stretched between pulleys 6 and 7. The recording cartridge 1 integrally has recording means (recording head) and an ink container.

The recording material 2 is fed (sub-scan) by sub-scan rollers 9 and 10 disposed upstream and downstream of a recording position with respect to the sheet sub-scan direction, through a position where the recording material faces the ink ejection outlets of the recording cartridge 1. While the carriage 3 moves (main scan) along the recording material 2, the ink ejector of the recording head 1 is driven in accordance with an image forming apparatus to effect the recording for one line. After completion of the recording of one line, the sub-scan rollers 9 and 10 are rotated through a predetermined amount to feed the recording material 2 in the direction indicated by an arrow (sub-scan). By repeating the main scan and the sub-scan alternately, the recording is effected over the entire surface of the recording material 2.

Referring to FIG. 1, at a position within the movable range of the recording cartridge 1 and outside the recording region, there is disposed a recovery mechanism 11 to assure the stabilized ink ejection of the recording head of the recording cartridge 1 and to prevent solidification of the ink after the apparatus is left unused for a long period of time. At the front side of the recovery mechanism 11, there is a cap 12 for hermetically sealing or capping the ink ejector during non-recording. Usually, The cap 12 is made of elastic rubber to assure the hermetical sealing.

Figure 2:
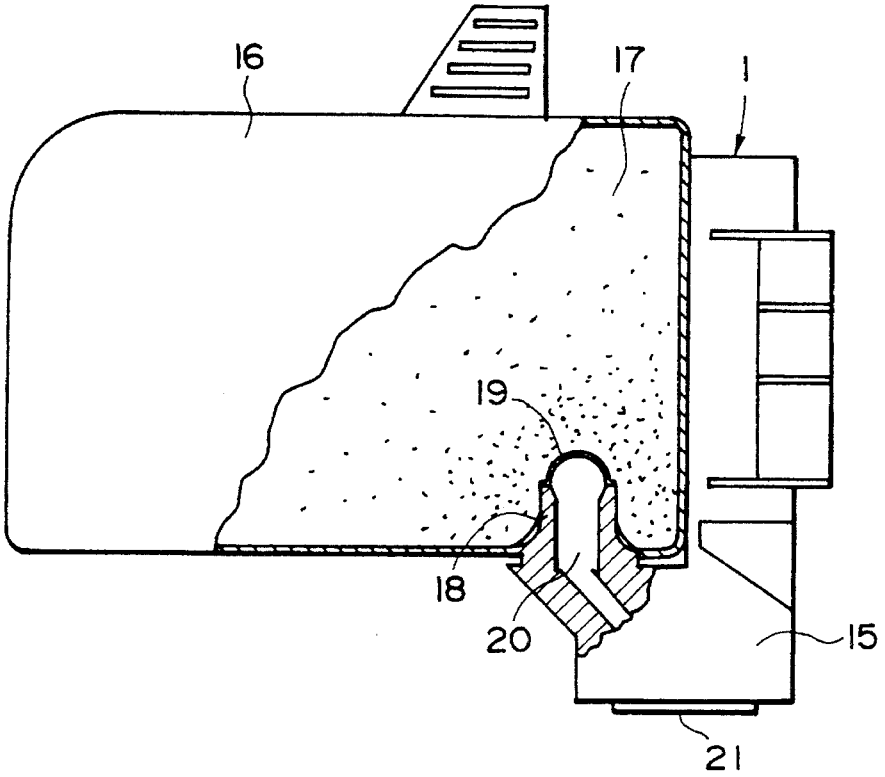
FIG. 2 is a partly broken side view of an ink jet cartridge according to the first embodiment.

FIG. 2 is a partly broken side view of a recording cartridge 1. In this figure, the recording cartridge 1 is in the form of a unit integrally having a recording means (recording head) 15 and an ink container 16 which is detachably mountable to the recording means. In the ink container 16, there is accommodated an ink absorbing material 17, and the ink is absorbed and retained in the ink absorbing material. The ink absorbing material 17 is in the form of a porous sponge having an elasticity. It can absorb and retain the ink by the capillary function of the porous material.

The recording head 15 is provided with an ink supply passage 18 for supplying the ink from the ink absorbing material 17 into the recording head 15. At an end of the ink Supply passage 18, there is provided a filter 19 abutted to the ink absorbing material 16 at the end of the ink absorbing material 17. The filter 19 functions to remove small foreign matters in the ink to be supplied, and is also effective to prevent introduction of fine bubbles into a communication port 20 in the ink passage 18.

The recording head 15 is an ink Jet recording means for ejecting the ink using thermal energy, and is provided with electrothermal transducers for producing thermal energy. The recording head 15 ejects the ink using pressure change caused by expansion and collapse of a bubble due to film boiling of the ink caused by the thermal energy applied by the electrothermal transducer. By the ejection of ink, the recording is effected.

Figure 3:
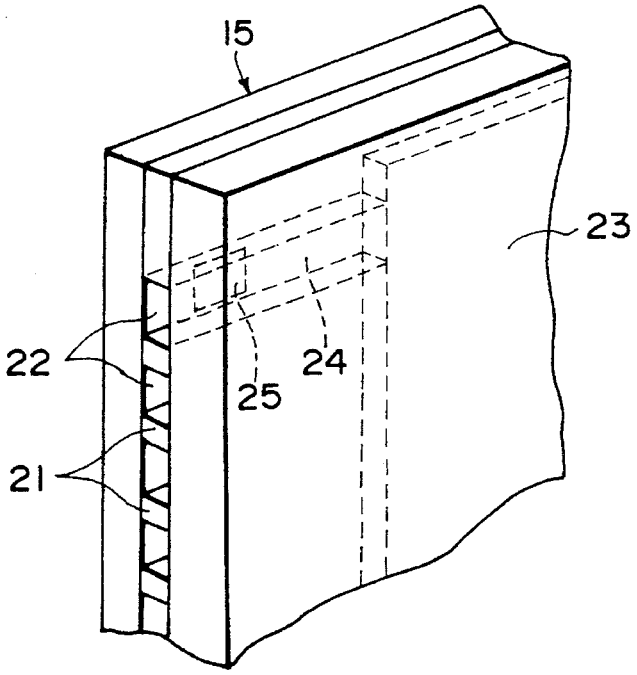
FIG. 3 is a partial perspective view of an ink ejection outlet of the recording means of FIG. 2.
Figure 4:
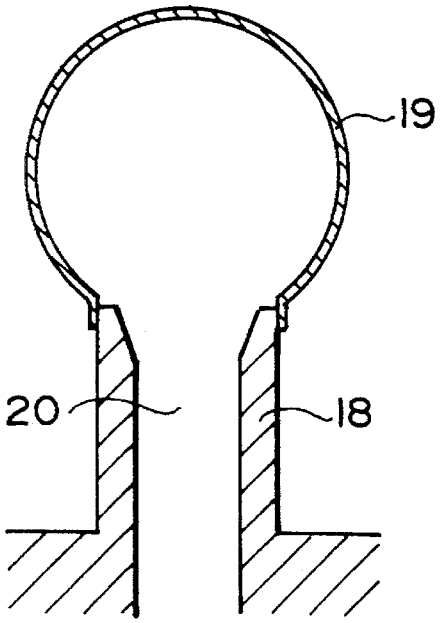
FIG. 4 is a partial longitudinal sectional view of a filter in FIG. 2 according to a second embodiment of the present invention.

FIG. 3 is a partial perspective view illustrating the structure of the ink ejecting portion of the recording head 15. In this figure, in the ejection side surface 21 facing the recording material 2 with a predetermined gap therebetween (approx. 0.5–2.0 mm. for example), is provided with a plurality of ejection outlets 22 at a predetermined pitch. Along a wall of each of the passages 24 in communication with the ejection outlet 22 and the common liquid chamber 23, an electrothermal transducer (heat generating resistor or the like) 25 for generating ink ejection energy is disposed. In this embodiment, the recording cartridge 1 having the recording head 15 is carried on a carriage 3 with such a positional relationship that the array of the ejection outlets 22 extends in a direction crossing with a main scan direction. The electrothermal transducers corresponding to the ejection signals or image signals are driven by an electric energy supply, by which the ink in the liquid passage 24 is film-boiled, and by the pressure produced at that time is effective to eject ink through the ejection outlets 22.

In FIG. 2, the filter 19 press-contacted to the ink absorbing material 12 at an end of the ink supply passage 18 has a configuration projecting into the ink absorbing material 17. More particularly, in the case of the filter 17 according to the first embodiment shown in FIG. 2, the configuration of the projected portion is semi-spherical or less-than-semi-spherical and shaped to have an arcuate surface of a constant curvature. Therefore, the end of the ink passage 18 and the filter 19 depresses into the ink absorbing material 17, by which the density of the ink absorbing material at the ink supply portion (adjacent to the ink supply passage 18) is increased, and the close contact between the filter 19 and the ink, absorbing material 17 is enhanced.

According to the structure of the ink supply passage 18 and the filter 19 of FIG. 2, the ink in the ink absorbing material 17 tends to be concentrated to the neighborhood of the ink supply passage 18, because the density there is high, and therefore, the capillary force is high there, and in addition, the introduction of the air into the interface between the filter 19 and the ink absorbing material 17 can be effectively prevented. In the example shown in FIG. 2, the filter 19 is semi-spherical and projects into the ink absorbing material 17, and the end portion of the communication port 20 of the ink supply passage 18 has a diverging configuration with which the cross-sectional area increases toward the ink absorbing material 17. By these structures, the occurrence of gap due to the deformation of the ink absorbing material 17 is minimized, thus decreasing the factor of the air introduction. The filter 19 may be fixed to the ink absorbing material 17 by heat fusing or a bonding agent or the like.

According to the first embodiment shown in FIG. 2, the filter 19 and the ink absorbing material 17 are in close contact with each other, and in addition, the sufficient press-contact force can be provided, and therefore, the air bubbles moving in accordance with the ink flow are trapped by the filter 19 and the ink absorbing material 17 having an increased density, so that the introduction into the communication port 20 of the ink supply passage 18 can be prevented. The spherical filter 19 is reinforced by the pressure of the ink absorbing material 17, and therefore, it can maintain its configuration without deformation, and therefore, the above-described advantageous effects can be maintained stably. Furthermore, since the configuration of the end portion of the communication port 20 of the ink supply passage 28 is diverging, the clearance between ink absorbing material 17 and the ink supply passage 19 can be eliminated, thus effectively preventing introduction of the air. In addition, the filter 19 is in contact with the ink absorbing material with a contact area which is larger than the cross-sectional area of the ink supply passage, and therefore, the ink supply area is increased, and the ink supply performance is enhanced.

By increasing the length of the ink supply passage 18, the density of the ink absorbing material 17 can be enhanced. However, with such a structure, the gap between the ink absorbing material 17 and the ink supply passage 18 becomes large with the result of difficulty in preventing sir introduction. According to this embodiment, however, this does not occur, and the introduction of the air into between the ink absorbing material 17 and the ink supply passage 19 and the air introduction from the filter 19 to the ink supply passage 18 (communication port 20) can be assuredly prevented. In this manner, according to the first embodiment shown in FIG. 2, the ink can be properly and stably supplied until the remaining quantity of the ink becomes zero or very small, and in addition, the ink can be stably and properly ejected. FIGS. 4–10 show other embodiments having different filters 19. In the second embodiment shown in FIG. 4, the configuration of the projected portion of the filter 19 is closer to a complete spherical shape, thus increasing the surface area of the filter 19. With this structure, the surface area of the filter 19 is large, and therefore, the resistance against the ink flow can be further lowered. In addition, the contact-pressure (close-contact force) between the filter 19 and the ink absorbing material 17 can be further increased.

Figure 5:
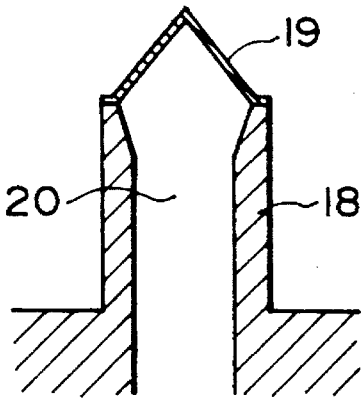
FIG. 5 is a partial longitudinal sectional view of the filter in FIG. 2 according to a third embodiment of the present invention.

FIG. 5 shows a third embodiment in which the projected filter 19 has a frusto-conical configuration. With this structure, when the length of the ink supply passage 18 is long or when the elasticity of the ink absorbing material 17 is high, the pressure distribution at the contact portion between the ink supply passage 18 and the ink absorbing material 17 may be concentrated along the length of the ink supply passage 17; and even in that case, the strength of the filter 19 can be increased.

Figure 6:
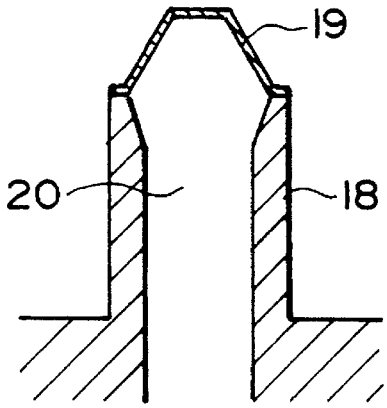
FIG. 6 is a partial longitudinal sectional view of the filter in FIG. 2 according to a fourth embodiment of the present invention.

FIG. 6 shows a fourth embodiment, in which the projected portion of the filter 19 has a frusto-conical configuration. This structure is effective to prevent pressure concentration at an apex of the filter 19, so that a permanent deformation of the ink absorbing material 17 press-contacted thereto can be prevented, and therefore, the pressure contact force (close-contactness) between the filter 19 and the ink absorbing material 17 can be stabilized.

Figure 7:
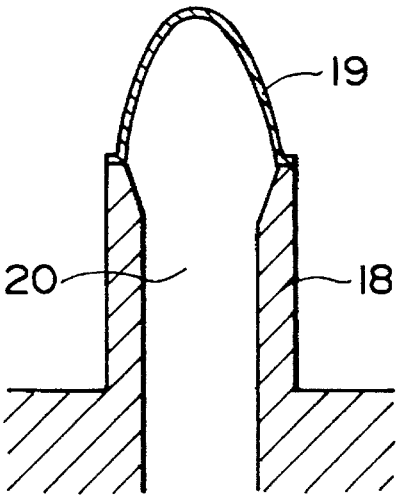
FIG. 7 is a partial longitudinal sectional view of the filter in FIG. 2 according to a fifth embodiment of the present invention.

Referring to FIG. 7, there is shown a fifth embodiment, in which the filter 19 has a paraboloid configuration. With this structure, the advantageous effects both of the frusto-conical filter of FIG. 6 and the spherical filter of FIG. 4 can be provided. In other words, the pressure distribution at the contact portion of the ink absorbing material 19 can be made uniform, and the resistance against the deformation of the filter 19 can be enhanced.

Figure 8:
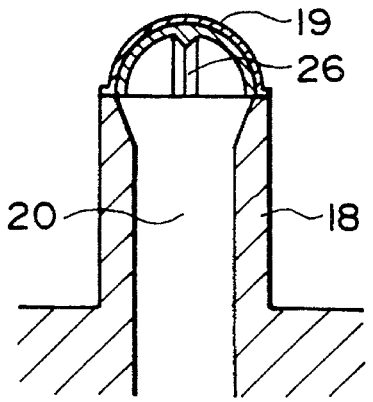
FIG. 8 is a partial longitudinal sectional view of a filter in FIG. 2 according to a sixth embodiment of the present invention.

FIG. 8 shows a sixth embodiment, in which a reinforcing member 26 is disposed along the inside surface of the filter 19. The reinforcing member functions to increase the durability against deformation of the filter 19 to prevent collapse of the filter 19, and it can be provided by a member constituting the ink supply passage 18 for another member.

Figure 9:
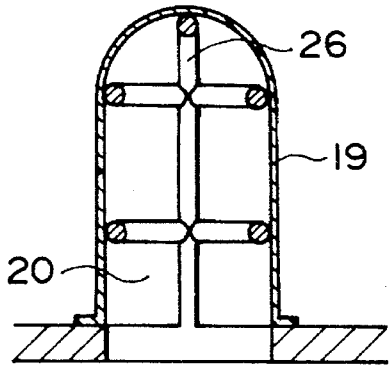
FIG. 9 is a partial longitudinal sectional view of a filter in FIG. 2 according to a seventh embodiment of the present invention.

FIG. 9 shows a seventh embodiment, in which the ink supply passage 18 is constituted by the filter 19, and along the inside surface of the filter 19, a reinforcing member 26 is disposed. As compared with the foregoing embodiments, part of the ink passage 18 is eliminated, and replaced with the filter 19. With this structure, the area of the filter 19 can be increased, thus decreasing the resistance against the ink flow.

Figure 10:
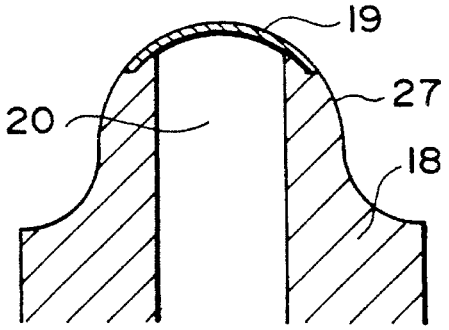
FIG. 10 is a partial longitudinal sectional view of the filter in FIG. 2 according to an eighth embodiment of the present invention.

FIG. 10 shows an eighth embodiment which is a modification of the first embodiment of FIG. 2, but the area of the filter 19 is decreased. In addition, the surface of the end portion of the ink supply passage 18 is generally converged by the converging surface 27. Correspondingly, the filter 19 is bonded to provide a continuous surface. With this structure, by decreasing the area of the filter 19, it is possible to decrease the cost. In addition, the pressure distribution of the portion contacting the ink absorbing material 17 can be made smooth.

According to the foregoing embodiments, the filter 19 and the ink absorbing material 17 are in close contact, and sufficient pressure contact force can be provided. The air bubbles moving with the ink flow are trapped by the filter 19 and the ink absorbing material 17 having an increased density, so that they are prevented from entering the communication port 20 of the ink supply passage. In addition, the filter 19 is enhanced by the pressure of the ink absorbing material 17, and the initial configuration can be maintained without deformation, and the above-described advantageous effects can be stably maintained. Furthermore, the gap between the ink absorbing material 17 and the ink supply passage 18 can be eliminated, and the introduction of the air can be further effectively prevented.

The ink in the ink absorbing material 17 tends to concentrate to the neighborhood of the ink supply passage 18 having high density and therefore high capillary force, and in addition, the introduction of the air at the interface between the filter 19 and the ink absorbing material 17 can be effectively prevented. In addition, the air introduction from the filter 19 into the ink supply passage 18 (communication port 20) can be assuredly prevented. In this manner, stabilized and proper ink supply can be carried out until the remaining Mount of the ink becomes zero or minimum, and the proper ink ejection can be accomplished.

In the foregoing description, a serial type ink jet recording apparatus has been taken in .which the recording material 2 is scanned in the main scan direction. However, the present invention is similarly applicable to a line type ink jet recording apparatus having a recording width covering a part or entirety of the width of the recording material. In the foregoing, the ink Jet recording apparatus comprises one recording cartridge, but the present invention is applicable to a color ink jet recording apparatus using a plurality of recording means to effect the recording with different full colors, or an ink jet recording apparatus using plural recording means containing same color but different density inks. Thus, the present invention is applicable irrespective of the number of recording means (recording cartridge) with the same advantageous effects.

An ink jet recording apparatus to which the present invention is applicable may comprise a recording head using electromechanical converters such as piezoelectric elements. However, an ink jet recording apparatus ejecting the ink using thermal energy is most preferable. In this case, a high density and fine image can be produced.

The present invention Is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600, wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984, wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

The ink jet recording apparatus may be used as an output terminal of an information processing apparatus such as a computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet cartridge comprising:

a head portion for emitting ink supplied from an ink container provided with ink absorbing material;

ink passage means defining an ink passage for supplying ink from the ink container to said head portion;

a filter disposed adjacent to one end of the ink passage and press-contacted against the absorbing material in the ink container, said filter shaped to have an arcuate surface of a constant curvature; and a reinforcing member provided along an inner side of said filter.

2. A cartridge according to claim 1, wherein said filter has a projected configuration of one half or less than one half of a sphere.

3. A cartridge according to claim 1, wherein said filter has a projected configuration of more than one half of a sphere.

4. A cartridge according to claim 1, wherein said head portion includes a recording head provided with an electrothermal transducer for producing thermal energy to eject the ink.

5. A cartridge according to claim 4, wherein said electrothermal transducer produces film boiling of the ink.

6. An ink jet apparatus, comprising:

a head portion for emitting ink;

an ink container portion containing ink to be supplied to said head portion;

ink passage means defining an ink passage for supplying ink from said ink container portion to said head portion;

ink absorbing material provided in said ink container;

a filter disposed adjacent to one end of the ink passage and press-contacted against said ink absorbing material, said filter shaped to have an arcuate surface of a constant curvature; and a reinforcing member provided along an inner side of said filter.

7. An apparatus according to claim 6, wherein said head portion includes a recording head provided with an electrothermal transducer for producing thermal energy to eject the ink.

8. An apparatus according to claim 7, wherein said electrothermal transducer produces film boiling of the ink.

9. An apparatus according to claim 6, further comprising feeding means for feeding a recording material to be recorded on by said head portion.

10. An ink jet cartridge comprising:

a head portion for emitting ink supplied from an ink container provided with ink absorbing material;

a member defining an ink passage for supplying ink from the ink container to said head portion;

a hemispherical projected portion provided at an end of said member and press-contacted against the ink absorbing member, wherein at least part of said hemispherical projected portion forms a filter shaped to have an arcuate surface of a constant curvature; and a reinforcing member provided along an inner side of said filter.

* * * * *

UNITED STATES PATENT AND TRADEMARK OFFICE

CERTIFICATE OF CORRECTION

PATENT NO. : 5,502,479

DATED : March 26, 1996

INVENTOR(S) : HIROYUKI ISHINAGA ET AL.

It is certified that error appears in the above-identified patent and that said Letters Patent is hereby corrected as shown below:

ON COVER PAGE

At [57] Abstract:

Line 2, "portion;" should read --portion,--.
Line 5, "filter" should read --filter is located--.

COLUMN 1

Line 9, "a" should read --an--.

COLUMN 2

Line 45, "comprising:" should read --comprising--.
Line 57, "comprising" should read --and including--.

COLUMN 4

Line 6, "The" should read --the--.
Line 21, "Supply" should read --supply--.
Line 27, "Jet" should read --jet--.
Line 56, "material 12" should read --material 17--.
Line 58, "filter 17" should read --filter 19--.
Line 67, "ink," should read --ink--.

COLUMN 5

Line 32, "passage 28" should read -- passage 18--.
Line 33, "passage 19" should read --passage 18--.

UNITED STATES PATENT AND TRADEMARK OFFICE

CERTIFICATE OF CORRECTION

PATENT NO. : 5,502,479

DATED : March 26, 1996

INVENTOR(S) : HIROYUKI ISHINAGA ET AL.

It is certified that error appears in the above-identified patent and that said Letters Patent is hereby corrected as shown below:

Line 44, "sir" should read --air--.
Line 47, "passage 19" should read --passage 18--.

COLUMN 6

Line 4, "17;" should read --18;--.
Line 19, "material 19" should read --material 17--.

COLUMN 7

Line 3, "Mount" should read --amount--.
Line 11, "Jet" should read --jet--.
Line 26, "Is" should read --is--.
Line 48, "the the" should read --the--.

Signed and Sealed this

Twenty-second Day of October, 1996

Bruce Lehman

*Attest:*

BRUCE LEHMAN

*Attesting Officer*

*Commissioner of Patents and Trademarks*